US007061431B1

(12) United States Patent
Tonn

(10) Patent No.: US 7,061,431 B1
(45) Date of Patent: Jun. 13, 2006

(54) SEGMENTED MICROSTRIP PATCH ANTENNA WITH EXPONENTIAL CAPACITIVE LOADING

(75) Inventor: David A. Tonn, Charlestown, RI (US)

(73) Assignee: The United States Of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/911,758

(22) Filed: Jul. 30, 2004

(51) Int. Cl.
*H01Q 1/38* (2006.01)

(52) U.S. Cl. ..... 343/700 MS

(58) Field of Classification Search ..... 347/700 MS
See application file for complete search history.

(56) References Cited

U.S. PATENT DOCUMENTS 4,218,682 A 8/1980 Yu
5,497,164 A 3/1996 Croq
5,708,444 A 1/1998 Pouwels et al.
5,818,391 A * 10/1998 Lee ..... 343/700 MS
5,933,115 A 8/1999 Faraone et al.
6,091,365 A * 7/2000 Derneryd et al. .... 343/700 MS
6,118,406 A 9/2000 Josypenko et al.
6,937,206 B1 * 8/2005 Puente Baliarda et al. . 343/853
2005/0012675 A1 * 1/2005 Sakiyama et al. ..... 343/824

* cited by examiner

*Primary Examiner*—Tho Phan
(74) *Attorney, Agent, or Firm*—Jean-Paul A. Nasser; James M. Kasischke; Michael P Stanley

(57) ABSTRACT

A segmented patch antenna has a dielectric material substrate, a plurality of primary electrically conductive segments consecutively disposed on the dielectric material substrate and spaced apart so that a portion of the substrate is exposed between any pair of adjacent primary segments, and a layer of dielectric material disposed over the primary segments. Secondary electrically conductive segments are disposed over the layer of dielectric material wherein each secondary segment corresponds to a pair of adjacent primary segments. Each secondary segment overlaps a portion of each primary segment of the corresponding pair of adjacent primary segments to which that secondary segments corresponds. The overlap of each secondary segment with a portion of each primary segment in a pair of adjacent primary segments produces a plurality of capacitive gaps that capacitively couple the primary and secondary segments together to define a single antenna.

8 Claims, 4 Drawing Sheets

SEGMENTED MICROSTRIP PATCH ANTENNA WITH EXPONENTIAL CAPACITIVE LOADING

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to a patch antenna, and more particularly to a microstrip patch antenna.

(2) Description of the Prior Art

A typical prior art microstrip patch antenna consists of a rectangular metallic "patch" that is printed on top of a grounded slab of dielectric material. Such a microstrip patch antenna suffers from limited bandwidth as a result of its resonant properties. Bandwidth of patch antennas is typically limited to 1–3% of the antenna's center frequency. This characteristic is due to the resonant properties of the antenna.

The prior art discloses several antenna structures. Yu U.S. Pat. No. 4,218,682 and Josypenko U.S. Pat. No. 6,118,406 disclose wideband antennas that are formed by stacking several resonant antennas on top of each other. Pouwels et al. U.S. Pat. No. 5,708,444 and Derneryd et al. U.S. Pat. No. 6,091,365 disclose array antennas that consist of a multitude of identical antenna elements, each of which being resonant, arranged in a regular grid pattern. Faraone et al. U.S. Pat. No. 5,933,115 discloses a planar antenna with patch radiators for wide bandwidth. The planar antenna utilizes a primary resonant patch and a smaller, resonant, parasitic element that is located near the primary resonant patch. Croq U.S. Pat. No. 5,497,164 discloses a multilayer radiating structure of variable directivity (i.e., gain). The actual radiating elements are arranged in a regular grid pattern. All of these prior art antenna systems and structures involve resonant structures. Specifically, the radiating elements themselves are all resonant devices.

SUMMARY OF THE INVENTION

It is an object of the present invention to provide a new and improved microstrip patch antenna that has improved bandwidth characteristics.

It is another object of the present invention to provide a microstrip patch antenna that does not support a resonant mode.

It is a further object of the present invention to provide a microstrip patch antenna that has improved bandwidth characteristics for a variety of antenna applications.

Other objects and advantages of the present invention will be apparent from the ensuing description.

Thus, the present invention is directed to a microstrip patch antenna that comprises a grounded dielectric material substrate, a plurality of primary electrically conductive segments consecutively disposed on the dielectric material substrate and spaced apart so that a portion of the dielectric material substrate is exposed between any pair of adjacent primary electrically conductive segments. The microstrip patch antenna further comprises a layer of dielectric material disposed over the plurality of primary electrically conductive segments and a plurality of secondary electrically conductive segments disposed over the layer of dielectric material wherein each secondary electrically conductive segment corresponds to a pair of adjacent primary electrically conductive segments. Each secondary electrically conductive segment is positioned over the exposed portion of the dielectric material substrate that is located between the adjacent primary electrically conductive segments. Each secondary electrically conductive segment overlaps a portion of the corresponding pair of adjacent primary electrically conductive segments. The overlap of each secondary segment with a portion of each primary segment in a pair of adjacent primary segments produces a plurality of capacitive gaps that capacitively couple the primary and secondary segments together to define a single antenna. A feedline is electrically connected to a first one of the plurality of primary segments.

The microstrip patch antenna of the present invention enhances bandwidth by reducing the resonant effects of the antenna. The microstrip patch antenna of the present invention does not have any portion or components that support a resonant mode. Thus, the primary and secondary electrically conductive segments and the feed structure do not support a resonant mode. The microstrip patch antenna of the present invention does not utilize parasitic elements and does not use capacitive coupling to connect the antenna structure to the feedline which is typically done in prior art patent antenna systems. In the microstrip patch antenna of the present invention, capacitive gaps are used to connect the individual segments into a single antenna.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, in which.

DESCRIPTION OF THE PREFERRED EMBODIMENTS

Figure 1:
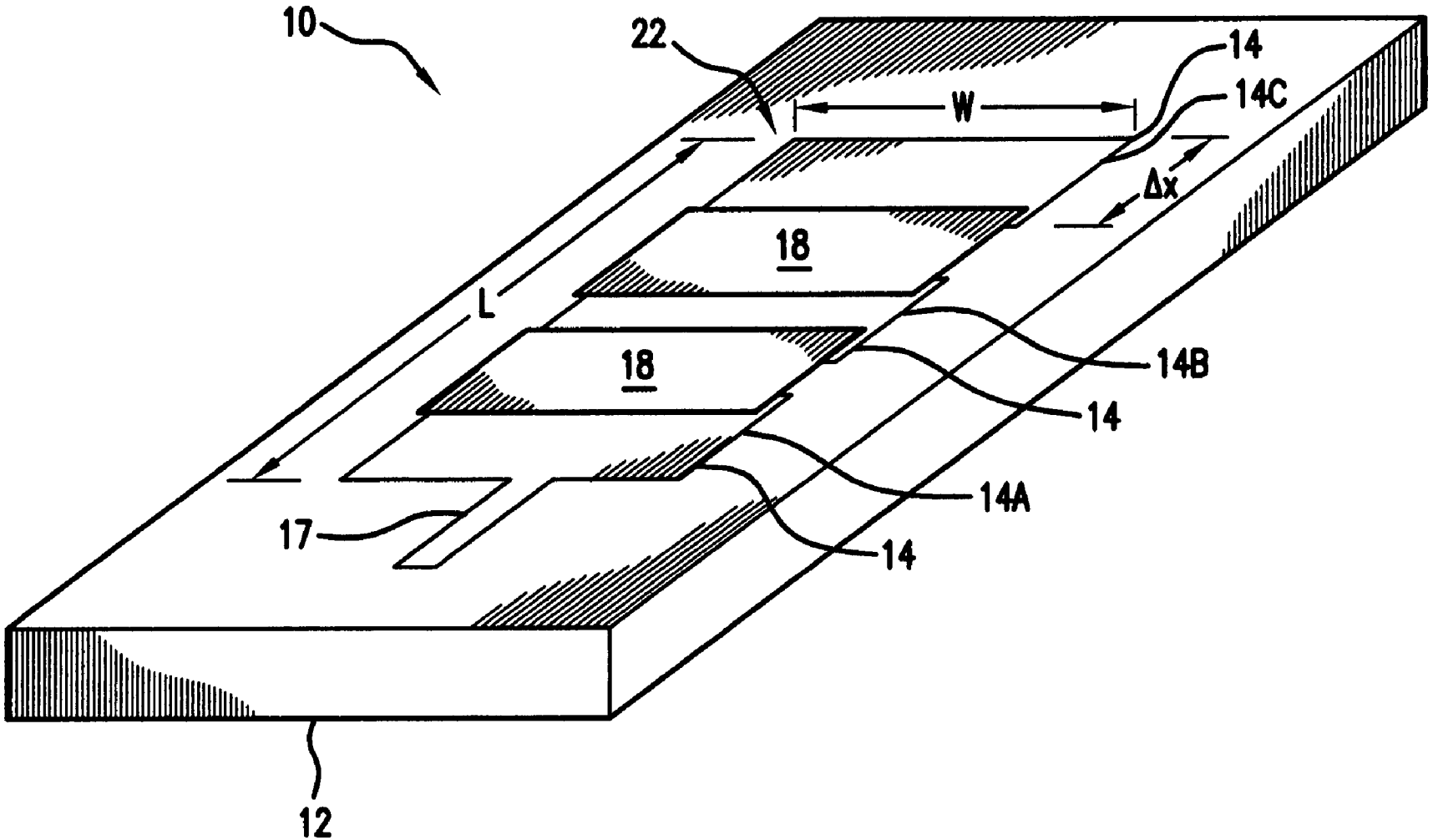
FIG. 1 is a perspective view of the microstrip patch antenna of the present invention.
Figure 2:
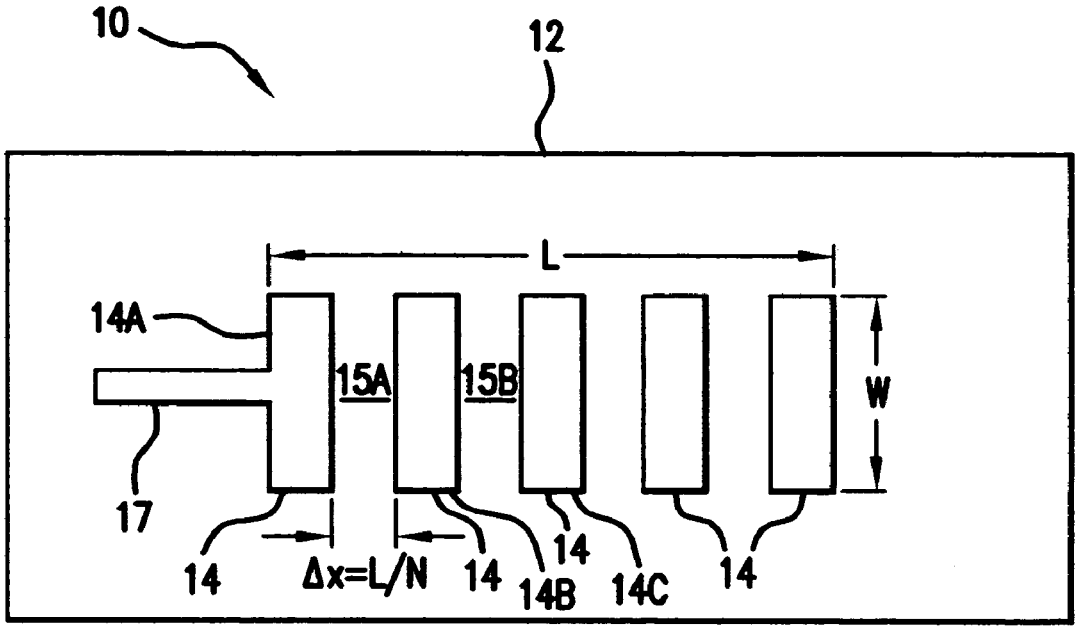
FIG. 2 is a top plan view of the microstrip patch antenna of the present invention, the secondary electrically conductive segments not being shown so as to facilitate viewing of the primary electrically conductive segments.
Figure 3:
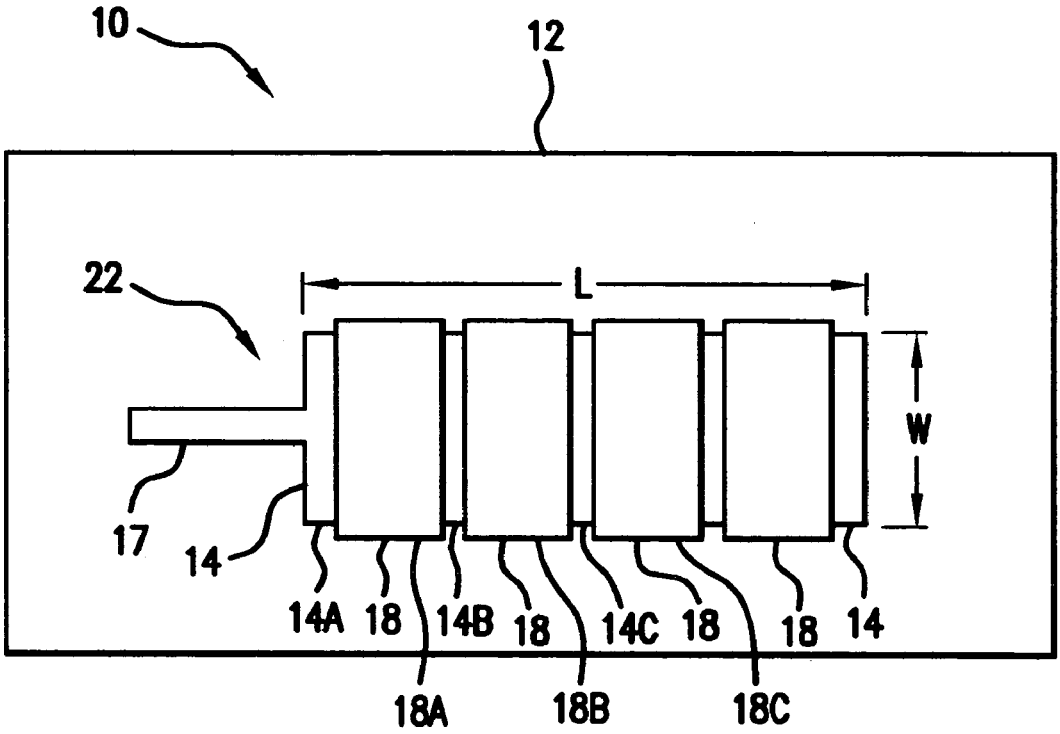
FIG. 3 is a top plan view of the microstrip patch antenna of the present invention.

Referring to FIGS. 1–3, there is shown microstrip patch antenna 10 of the present invention. Microstrip patch antenna 10 comprises substrate 12 of grounded dielectric material. The material from which substrate 12 is fabricated depends upon the frequency of operation. Suitable materials that can be used to fabricate substrate 12 include Teflon™, FR4 and Duroid. Preferably, substrate 12 is generally planar and is substantially rectangular shape. Microstrip patch antenna 10 further comprises N primary segments 14 of electrically conductive material that are disposed over substrate 12. In a preferred embodiment, each primary segment 14 is configured as single strip or piece of metal that has a substantially flat or planar top surface. In one embodiment, primary segments 14 are plated onto substrate 12 in accordance with techniques known in the art. Preferably, the metal selected for use in fabricating primary segments 14 has excellent electrical conductivity characteristics. Examples of metals for fabricating each primary segment 14 include copper and silver. In an alternate embodiment, vapor deposited aluminum may be used to fabricate each primary segment 14. FIG. 2 shows substrate 12 having primary segments 14 plated thereon. Each primary segment 14 has a width ΔX. Primary segments 14 are spaced apart by distance that is substantially the same as ΔX. Consequently, a portion of dielectric material substrate 12 is exposed between any pair of adjacent primary segments 14. For example, a portion 15A of substrate 12 is exposed between adjacent primary segments 14A and 14B. In another example, a portion 15B of substrate 12 is exposed between adjacent primary segments 14B and 14C. The actual number N of primary segments depends upon the desired operational characteristics of antenna 10. In a preferred embodiment, the number N of primary segments is 5 or more segments.

Figure 4:
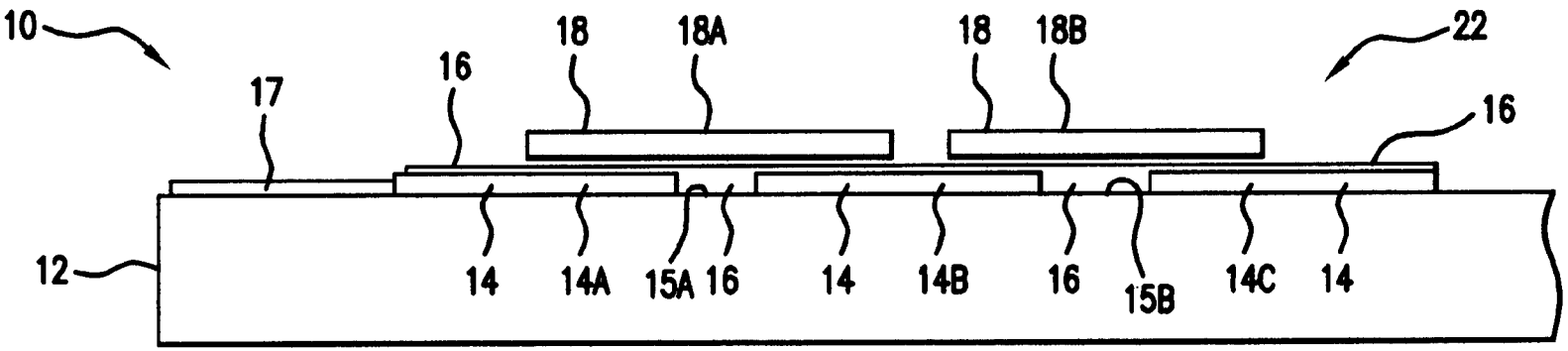
FIG. 4 is a partial, side-elevational view of the microstrip patch antenna of the present invention.
Figure 5:
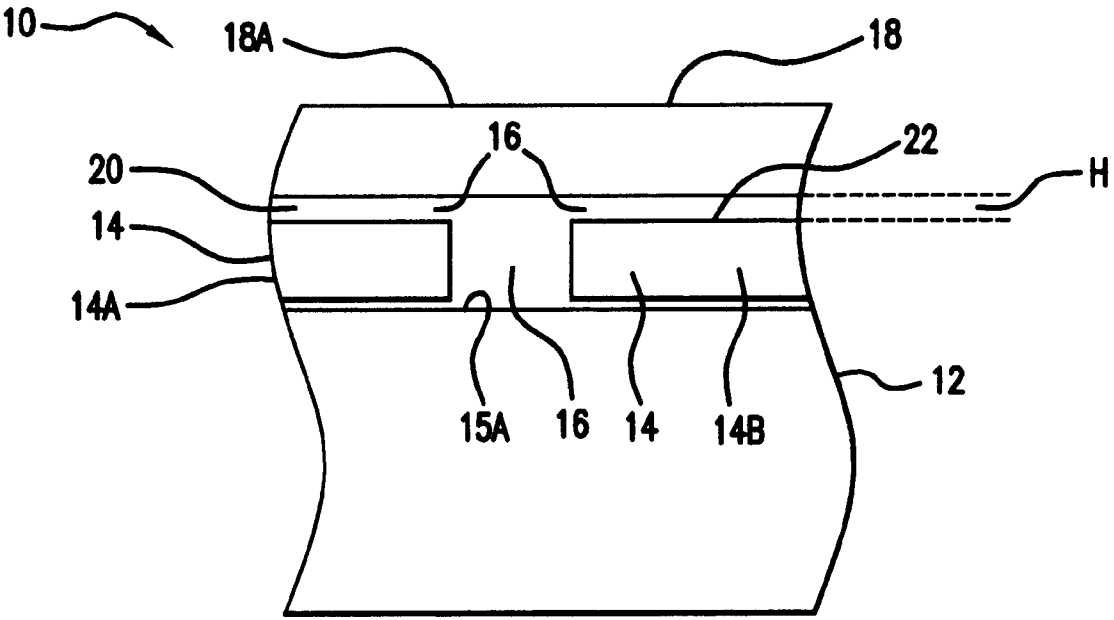
FIG. 5 is a partial, cross-sectional view of the microstrip patch antenna of the present invention that shows capacitive gaps produced by the overlapping of secondary electrically conductive segments with the primary electrically conductive segments.

Referring to FIGS. 4 and 5, patch antenna 10 further comprises a relatively thin layer or sheet 16 of dielectric material that is disposed over primary segments 14. In a preferred embodiment, layer 16 is fabricated from the same material used to fabricate substrate 12. In one embodiment, layer 16 is adhered to primary segments 14 with a suitable adhesive. Other suitable techniques can be used to dispose layer 16 over the primary segments 14. Layer 16 of dielectric material has a predetermined thickness that depends upon the desired operational characteristics of patch antenna 10.

Antenna 10 includes feedline 17 that is electrically connected to first primary segment 14A. In one embodiment, feedline 17 is configured as a microstrip feedline. In an alternate embodiment, feedline 17 is configured as a coaxial probe.

Referring to FIGS. 1, 3, 4 and 5, patch antenna 10 further comprises N−1 secondary segments 18 of electrically conductive material that are disposed over layer 16 of dielectric material. In accordance with the invention, each secondary segment 18 has a width that is greater than width ΔX of each primary segment 14. In a preferred embodiment, each secondary segment 18 is configured as single strip or piece of metal that has a substantially flat or planar top surface. In one embodiment, secondary segments 18 are plated onto layer 16 of dielectric material in accordance with techniques known in the art. Preferably, the metal selected for use in fabricating secondary segments 18 has excellent electrical conductivity characteristics. Suitable metals for fabricating each secondary segment 18 include copper and silver. In an alternate embodiment, vapor deposited aluminum is used to fabricate each secondary segment 18. Each secondary segment 18 corresponds to a pair of adjacent primary segments 14 and is positioned over the exposed portion of substrate 12 that is between those adjacent primary segments 14. Each secondary segment 18 overlaps a portion of each primary segment 14 in the pair of adjacent primary segments 14 to which the secondary segment 18 corresponds. Thus, for example, secondary segment 18A is disposed over layer 16 such that secondary segment 18A is located over the exposed portion 15A of substrate 12 that is between primary segments 14A and 14B and overlaps a portion of primary segment 14A and primary segment 14B (see FIGS. 4 and 5). The overlapping of a portion of secondary segment 18A with the portion of primary segment 14A cooperates with layer 16 to form capacitive gap 20 (see FIG. 5). Similarly, the overlapping of a portion of secondary segment 18A with a portion of primary segment 14B cooperates with layer 16 to form capacitive gap 22. Other capacitive gaps are formed in the same manner by the overlapping of secondary segments 18 with portions of primary segments 14. In accordance with the invention, these capacitive gaps capacitively couple together the primary and secondary segments 14 and 18, respectively, to form a segmented patch that is indicated by reference numeral 22 in FIG. 1. The capacitance of each gap 20 is controlled by the amount of overlap of each secondary segment 18 with corresponding portions of primary segments 14. The vertical distance or gap between primary segment 14 and overlapping secondary segment 18 is indicated by letter H in FIG. 5. The vertical distance H remains constant and therefore is the same for each gap 20. The distance H is primarily determined by the thickness of layer 16 and any adhesive used to adhere layer 16 to primary segments 14. In accordance with the invention, the capacitances formed at each capacitive gap (e.g. capacitive gaps 20, 22) are chosen to reduce the resonant properties of antenna 10 over the passband of interest. The capacitances at the capacitive gaps decrease exponentially from one electrically conductive segment to the next electrically conductive segment and is represented by formula (1):

$$C_i = C_0 e^{\alpha i \Delta x} \tag{1}$$

wherein $C_0$ is the capacitance of the first capacitive gap 20 and α is a real parameter referred to as the taper factor. Thus, the capacitance of the subsequent capacitive gaps decrease as one moves in a direction away from feedline 17. Consequently, the magnitude of the current wave on antenna 10 is reduced as the current wave travels along patch 22 and reduces the formation of a resonant standing wave on microstrip patch antenna 10.

In a preferred embodiment of the invention, the capacitance of the capacitive gap 20 is selected so that its capacitive reactance at the lowest desired frequency of operation is no more than about one tenth of the characteristic impdence of the atenna 10 if it is treated as a transmission line. This impedence is determined by the width of the patch 22, the thickness of the lower dielectric substrate 12, and the substrate's 12 dielectric constant.

It is to be understood that the drawing figures are for illustrative purposes only and shall not be interpreted as limiting the number of primary segments 14 or secondary segments 18 to that shown in the figures. The actual number of primary and secondary segments depends upon the desired operational parameters of patch antenna 10 of the present invention.

Referring to FIGS. 1–3, segmented patch 22 has an overall length L and a width W. Width W is defined by the individual length of primary segments 14. The overall length L of patch 22 is determined by formula (2):

$$L = N \times \Delta X \tag{2}$$

wherein L is the overall length of patch 22, N is the number of primary segments 14, ΔX is the width of each individual primary segment 14 and the width of the space between each adjacent pair of primary segments 14.

A microstrip patch antenna, in accordance with the invention, was constructed in accordance with the parameters shown in Table I:

TABLE I

| | |
|---|---|
| Length L of Segmented Patch | 31.0 mm |
| Width W of Segmented Patch | 19.0 mm |
| Thickness of Duroid Substrate | 2.0 mm |
| Thickness H of Dielectric Layer | 0.05 mm |
| Bandcenter | 6.0 GHz |
| Number of Primary Segments | 11 |
| Number of Secondary Segments | 10 |
| Capacitance of First Capacitive Gap | 20.7 pF |
| Taper Factor | 20/mm |

Figure 6:
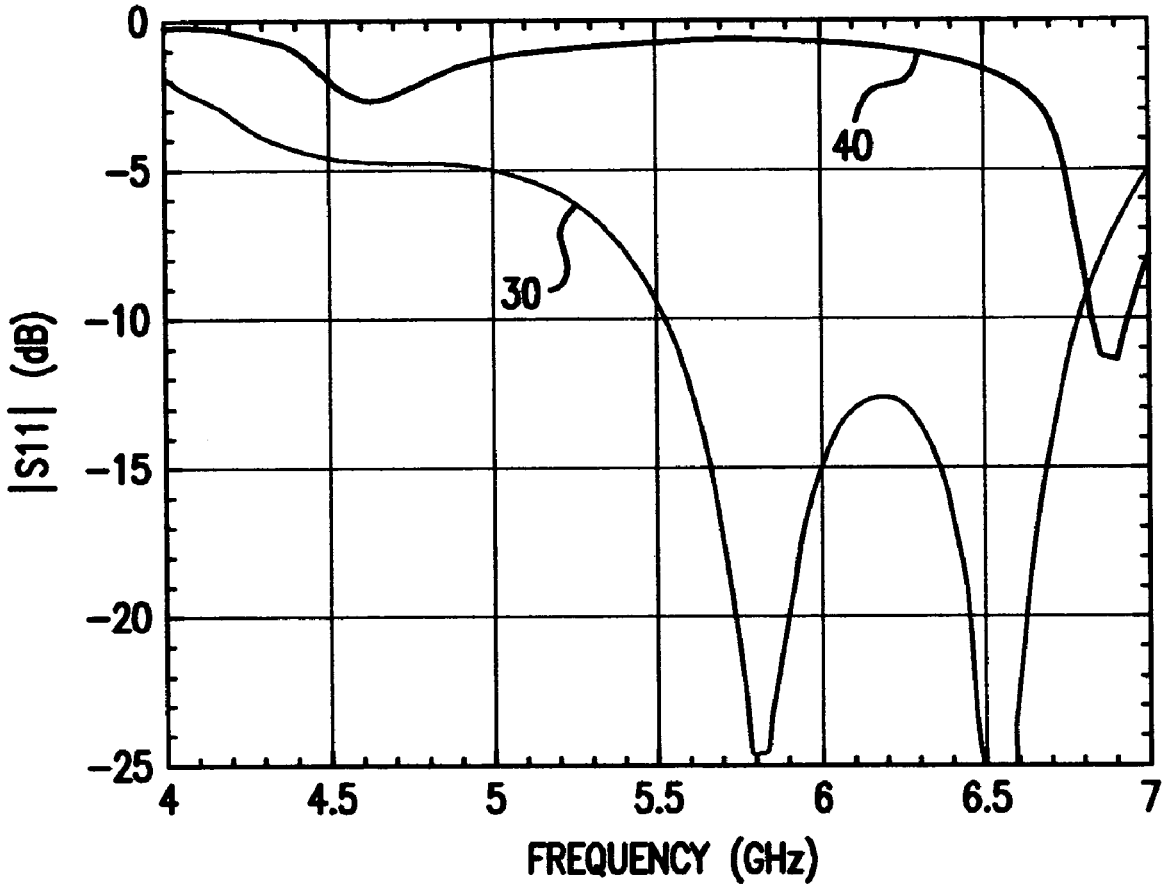
FIG. 6 is a graph comparing bandwidth performance of a conventional patch antenna with that of an embodiment of the microstrip patch antenna of the present invention.

The antenna built in accordance with the parameters shown in Table I exhibited the characteristics indicated by curve 30 in FIG. 6. The operational characteristics of a conventional unsegmented, resonant patch antenna exhibited the characteristics indicated by curve 40 in, FIG. 6. In this test, the conventional unsegmented patch had a length of 31.0 mm, a width of 19.0 mm and was deposited on a substrate having a thickness of 2.0 mm. If the passband is defined as the region where |S11| is less than −10 dB, indicating that less than 10% of the forward power on feedline 17 is reflected back, then the embodiment of the patch antenna of the present invention built according to the parameters of Table I has a bandwidth of approximately 1.250 GHz, or about 20%, whereas the conventional patch has a passband of about 10 MHz or 1.4%.

None of the components or portions of microstrip patch antenna 10 utilize or support a resonant mode. Thus, primary segments 14, secondary segments 18 and feedline 17 do not support a resonant mode. Patch antenna 10 of the present invention does not utilize parasitic elements and does not use capacitive coupling to connect the antenna structure to the feedline which is typically done in prior art patch antennae. The capacitive gaps (e.g. capacitive gap 20) that are used to connect together the individual primary and secondary segments 14 and 18, respectively, also produce a current distribution that is tapered, thereby suppressing the current standing wave on the antenna as well as the resonant nature of the antenna. The patch antenna of the present invention achieves significantly enhanced bandwidth without increasing the thickness of the antenna or degrading the efficiency of the patch antenna.

In an alternate embodiment; primary segments 14 are printed on substrate 12. In such an embodiment, layer 16 is adhered to the printed primary segments and secondary segments 18 are disposed over layer 16 by any suitable technique.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A patch antenna, comprising:

a dielectric material substrate;

a plurality of primary electrically conductive segments consecutively disposed over the dielectric material substrate and spaced apart so that a portion of the dielectric material substrate is exposed between any pair of adjacent primary electrically conductive, wherein each primary segment has a predetermined width and wherein the primary segments are spaced apart by a distance that is substantially the same as the predetermined width;

a layer of dielectric material disposed over the plurality of primary electrically conductive segments;

a plurality of secondary electrically conductive segments having a width greater than the predetermined width of each primary electrically conductive segment disposed over the layer of dielectric material such that each secondary electrically conductive segment corresponds to a pair of adjacent primary electrically conductive segments, each secondary electrically conductive segment being positioned over the exposed portion of the dielectric material substrate that is located between the pair of adjacent primary electrically conductive segments to which that secondary electrically conductive segment corresponds and overlaps a portion of each primary electrically conductive segment in the pair of adjacent primary electrically conductive segments; and whereby the overlap of each secondary electrically conductive segment with a portion of each primary electrically conductive segment in the pair of adjacent electrically conductive segments to which that secondary electrically conductive segment corresponds produces a plurality of capacitive gaps that capacitively couple the primary and secondary electrically conductive segments together to define a patch antenna; and a feedline electrically connected to a first one of the plurality of primary electrically conductive segments.

2. The patch antenna according to claim 1 wherein the quantity of primary electrically conductive segments is N and the quantity of secondary electrically conductive segments is N−1.

3. The patch antenna according to claim 1 wherein the feedline comprises a microstrip feedline.

4. The patch antenna according to claim 1 wherein the feedline comprises a coaxial probe.

5. The patch antenna according to claim 1 wherein the substrate is substantially rectangular.

6. The patch antenna according to claim 1 wherein each primary electrically conductive segment is substantially rectangular.

7. The patch antenna according to claim 1 wherein each secondary electrically conductive segment is substantially rectangular.

8. The patch antenna according to claim 1 wherein the layer of dielectric material is adhered to the plurality of the primary electrically conductive segments.

* * * * *